US005389758A

United States Patent [19]

Agnatovech

[11] Patent Number: 5,389,758

[45] Date of Patent: Feb. 14, 1995

[54] PUSHBUTTON SWITCH

[75] Inventor: William J. Agnatovech, Franklin, Mass.

[73] Assignee: Augat Inc., Mansfield, Mass.

[21] Appl. No.: 171,616

[22] Filed: Dec. 22, 1993

[51] Int. Cl.[6] ..... H01H 13/14

[52] U.S. Cl. ..... 200/530; 200/531; 200/520; 200/302.2

[58] Field of Search ..... 200/530, 531, 536, 252, 200/302.2, 303, 295, 293, 520

[56] References Cited

U.S. PATENT DOCUMENTS 4,766,272 8/1988 Guzzon ..... 200/531

4,882,461 11/1989 Kamisada ..... 200/536

5,063,276 11/1991 Woodard ..... 200/530

*Primary Examiner*—Henry J. Recla

*Assistant Examiner*—David J. Walczak

*Attorney, Agent, or Firm*—Weingarten, Schurgin, Gagnebin & Hayes

[57] ABSTRACT

A miniature pushbutton switch of modular construction is provided. The switch can be readily assembled in an inexpensive manner without need for skilled personnel and without need for any special assembly tooling. In a preferred embodiment, the switch includes respective assemblies each of plastic molded construction which are configured to be snap fitted together for final assembly of the switch.

13 Claims, 4 Drawing Sheets

PUSHBUTTON SWITCH

FIELD OF THE INVENTION

This invention relates to miniature electrical switches, and more particularly to miniature pushbutton switches.

BACKGROUND OF THE INVENTION

A variety of miniature pushbutton switches are known. However, the most common of these prior art switches require tools for assembling the switch components within its housing. Most known switches include individual contacts, sliders and other components which must be carefully and individually assembled within a housing. This assembly procedure is time consuming and requires trained personnel or expensive automated equipment. The cost of manufacture thereby suffers by the need for skilled personnel or automated assembly equipment. There is a need for a miniature pushbutton switch which is simple and inexpensive to assemble without the requirement of skilled personnel or complex automated equipment.

SUMMARY OF THE INVENTION

In brief, the present invention provides a miniature pushbutton switch of modular construction which can be readily assembled in an inexpensive manner without need for skilled personnel and without need for any special assembly tooling. In a presently preferred embodiment, the switch includes respective assemblies each of plastic molded construction and which are configured to be snap fitted together for final assembly of the switch.

A platform assembly is comprised of a base portion and at least one conductor carrier portion having electrical conductors which terminate in first and second sets of contacts. The base portion includes one or more retention elements integrally formed therewith and cooperative with elements on the carrier portion for retaining the conductor carrier portion in intended disposition on the base portion. A housing or encasement assembly includes one or more retention elements cooperative with retention elements of the base portion for locking the housing onto the base portion.

A plunger assembly is retained within the housing assembly and includes a slider block having an electrical shorting element retained therein and cooperative with one set of contacts of the conductor carrier portion, and coupled to a pushbutton actuator which outwardly extends through an opening in the housing. A spring or other bias element urges the plunger assembly to an outward position in the absence of finger pressure applied to the plunger actuator element. A rubber or other resilient water impermeable boot is fitted about the plunger actuator and surrounding fitting of the housing assembly to prevent moisture and other contamination from entering the interior of the housing.

BRIEF DESCRIPTION OF THE DRAWINGS

These and other features and advantages of the present invention will be better understood by reading the following detailed description, taken together with the drawings wherein.

DETAILED DESCRIPTION

Figure 1:
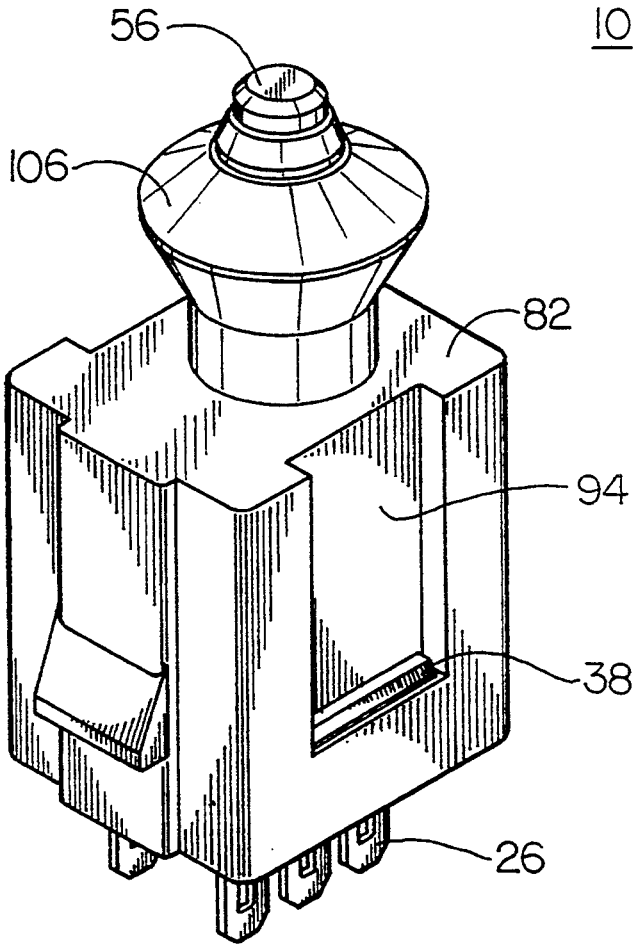
FIG. 1 is a left side view of a miniature pushbutton switch according to the invention.

Referring now to FIG. 1, a miniature pushbutton switch of modular construction 10 is illustrated. The switch 10 is, in one embodiment, manufactured of molded, resilient parts such that assembly is accomplished by snap-fitting the parts together, thus eliminating a need for tools or complex assembly procedures. Injection molding techniques are sufficiently advanced to enable inexpensive and accurate piece part manufacture after creation of proper molds.

Figure 2:
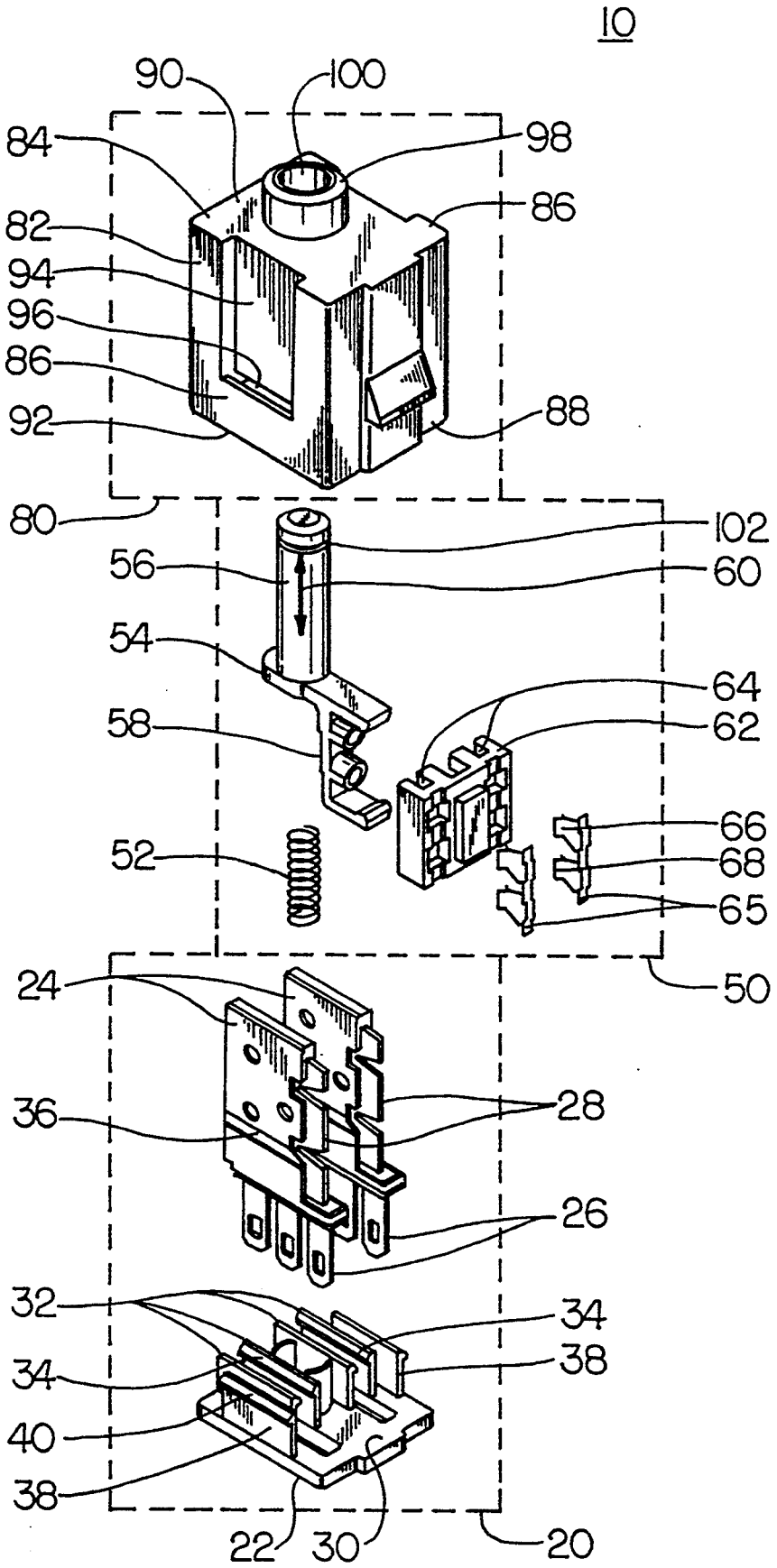
FIG. 2 is an exploded perspective view of the switch of FIG. 1.
Figure 3:
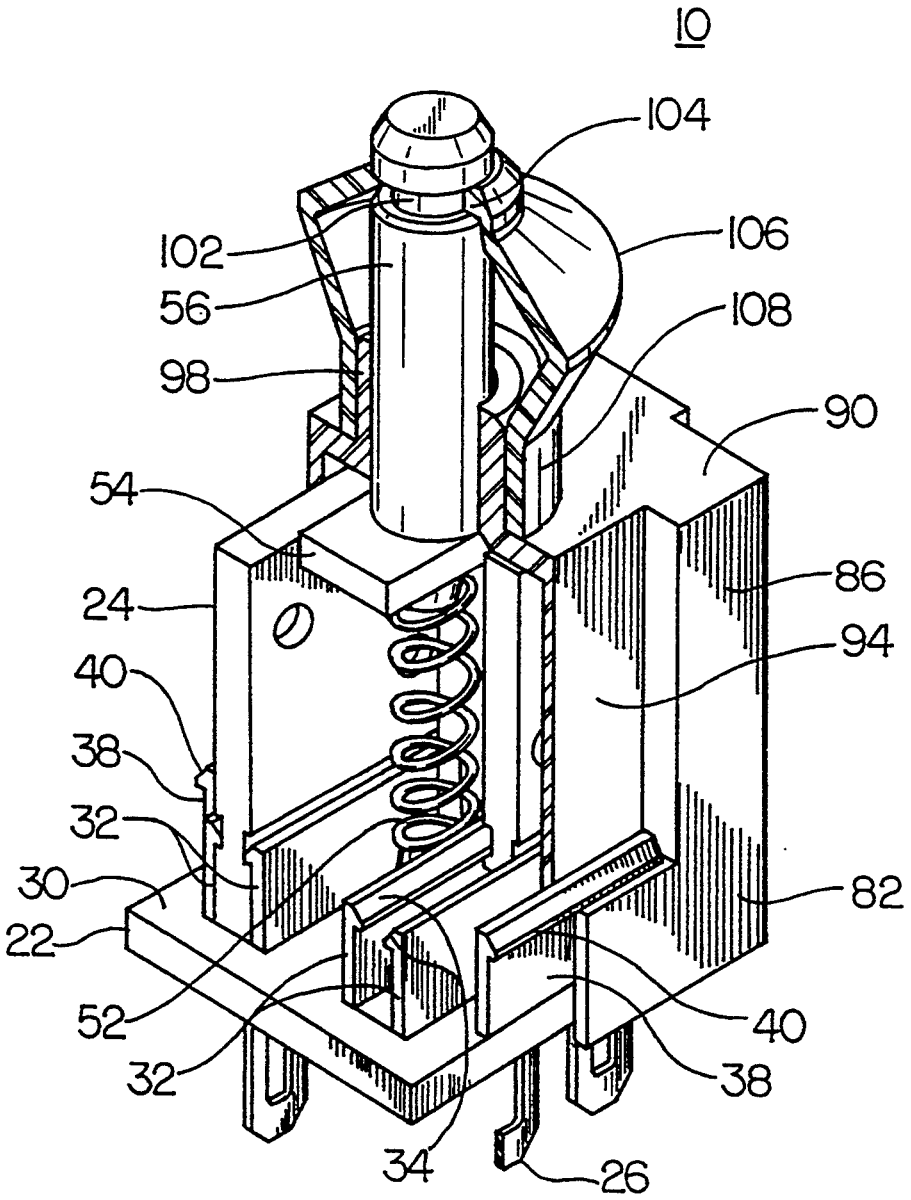
FIG. 3 is a cut-away perspective view of the switch of FIG. 1.
Figure 4:
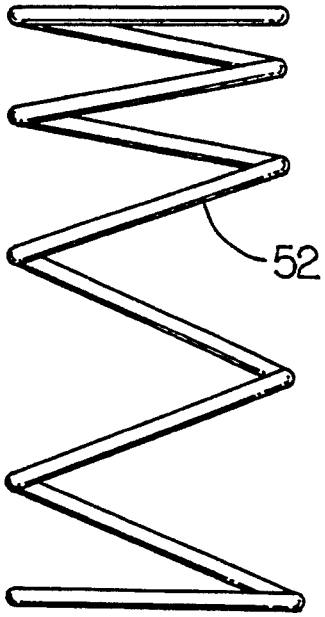
FIG. 4 is a side view of an alternative embodiment of a bias element as used in the switch of FIG. 1.

In FIGS. 2 and 3, the miniature pushbutton switch of modular construction 10 is shown comprised of a platform assembly 20, a pushbutton assembly 50, and an encasement assembly 80. The platform assembly 20 is comprised of a base portion 22 and at least one conductor carrier portion 24 disposed thereon. Within each conductor carrier portion 24 are electrical conductors (not shown) which terminate in first contacts 26 extending through the base portion 22, and second contacts 28 projecting rearwardly from the conductor carrier portion 24.

At least one carrier retention element 32 is integrally formed on a first surface 30 of the base portion 22. A hook portion 34 formed along a distal edge of the carrier retention element 32 is positioned to snap into a groove 36 disposed in the conductor carrier portion 24, thus retaining the conductor carrier portion 24 against the first surface 30 of the base portion 22.

Also integrally formed on the first surface 30 of the base portion 22 is at least one housing retention element 38, similarly having a hook portion 40 disposed thereon. The housing retention element 38 acts to hold a housing 82 against the base portion 22, as described hereinafter.

The pushbutton assembly 50 is comprised of a bias element 52, a pushbutton actuator 54, and a slider block 62. The bias element 52, in the illustrated embodiment, is a coiled spring which reacts to compressive force transmitted through the pushbutton actuator 54. In an alternative embodiment, the bias element 52 is a quasi-cylindrical spring offering non-linear resistance to the compressive force. Further, the bias element 52 can take the form of a leaf spring or the like. In a preferred embodiment, the bias element 52 is disposed between the pushbutton actuator 54 and the base portion 22 to bias the pushbutton actuator 54 away from the base portion 22.

For easier reference, the one-piece pushbutton actuator 54 is divided into a shaft portion 56 and a mounting portion 58. Compressive force is applied to the pushbutton actuator 54 by an operator via the shaft portion 56. The shaft portion 56 extends upward from the bias element 52 and is positioned substantially coaxial with an axis of movement 60 of the bias element 52.

Figure 5:
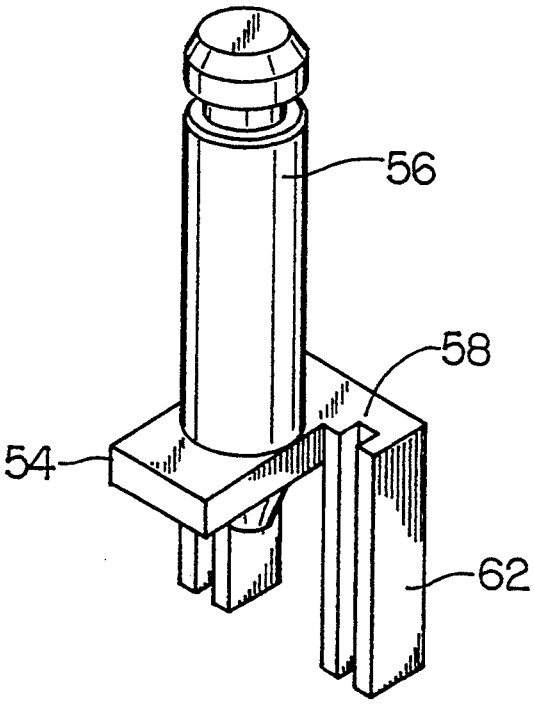
FIG. 5 is an alternative embodiment of a pushbutton actuator for use in the switch of FIG. 1.

Moving parallel to this axis 60 is the mounting portion 58 of the pushbutton actuator 54. The mounting portion 58 provides an attachment point for the slider block 62, a block of insulative material such as plastic. In an alternative embodiment as illustrated in FIG. 5, the slider block 62 is integrally formed on the mounting portion 58 to form a one piece pushbutton actuator 54. In either embodiment, the slider block 62 has at least one vertically oriented slot 64. Within the slot 64 is a shorting conductor 65 having a first shorting contact 66 and a second shorting contact 68.

When assembled in the switch 10 of the present invention, the first and second shorting contacts 66, 68 of the slider block 62 are in electrical communication with at least one of the second contacts 28 projecting rearwardly from the conductor carrier portion 24, described above. Compressive force urging the pushbutton actuator 54 toward the base portion 22 also moves the slider block 62, thus bringing the first and second shorting contacts 66, 68 into contact with at least one different rearwardly projecting second contact 28. In an alternative embodiment of the present invention, a first pair of rearwardly projecting second contacts 28 are shorted by the slider block 62 when no compressive force is applied, and a second pair of second contacts 28 are shorted when compressive force is applied.

The encasement assembly 80 comprises a housing 82 and a flexible tubular boot 106 (not illustrated in FIG. 2). The housing 82, in the embodiment illustrated, has a front surface 84, two side surfaces 86, and a rear surface 88, each of which has a bottom edge 92 and each of which abuts an upper surface 90. A vertical recess 94 is disposed in each of the side surfaces 86 of the housing 82 and extends from the upper surface 90 to a point proximate the bottom edge 92 of the respective side surface 86. Through the point proximate the bottom edge 92 in the vertical recesses 94, a rectangular void 96 is formed. To mount the housing 82 onto the base portion 22, at least one housing retention element 38 is directed through the rectangular void 96, whereupon the hook portion 40 disposed on the housing retention element 38 engages the side surface 86 of the housing 82, thus retaining the housing 82 against the base portion 22.

In the switch 10 embodiment illustrated in FIGS. 2 and 3, two housing retention elements 38 are provided. However, it is contemplated that as few as one and as many as four or more housing retention elements 38 could be disposed about the base portion 22, with a corresponding number of vertical recesses 94 and associated rectangular voids 96 disposed on the housing 82. Furthermore, it is contemplated that the voids 96 could be any geometric shape, such as square, depending on the projection of the housing retention element 38. Finally, an alternative embodiment to the vertical recesses 94 which extend to the upper surface 90 of the housing 82 are recesses 94 which extend only slightly above the rectangular void 96.

Integrally formed on the upper surface 90 of the housing 82 is a raised collar 98 defining a pushbutton assembly orifice 100. Once the housing 82 is fastened onto the base portion 22, the shaft portion 56 of the pushbutton actuator 54 extends through the pushbutton assembly orifice 100. In an alternative embodiment, the pushbutton assembly orifice 100 has a different geometric shape, depending on the projection of the shaft portion 56.

At a distal end of the shaft portion 56 is formed an annular groove 102. The annular groove 102 is positioned on the shaft portion 56 such that it extends beyond the upper surface 90 and raised collar 98 once the housing 82 is fastened onto the base portion 22. Once so assembled, a first neck portion 104 of the flexible tubular boot 106 manufactured of rubber or the like is inserted into the annular groove 102. A second neck portion 108 of the tubular boot 106 is disposed over the raised collar 98, thus preventing the introduction of foreign matter into the assembled switch via the pushbutton assembly orifice 100.

In an alternative embodiment, the encasement assembly 80 does not include a boot 106. In such an embodiment, there would be no need for the annular groove 102 on the shaft portion 56.

While assembly of the switch 10 as described requires no tools, it is envisaged that a sealing substance such as glue, epoxy or the like can be employed to more thoroughly seal off the interior of the switch 10. It is also envisaged that the switch 10 of the present invention be assembled by relatively uncomplicated automated assembly machinery.

Furthermore, while two conductor carrier portions 24 are illustrated in the accompanying FIGS. 2 and 3, it is clear that as few as one and more than two such carrier portions 24 could interface with a slider block 62 suitable for such application.

Although the invention has been shown and described with respect to an illustrative embodiment thereof, it should be understood by those skilled in the art that the foregoing and various other changes, omissions and additions in the form and detail thereof may be made therein without departing from the spirit and scope of the invention.

I claim:

1. A switch comprising:

a platform assembly, comprising a base portion having retention elements integral therewith, and at least one conductor carrier portion having a plurality of electrical conductors which terminate in first and second sets of contacts, and a retention portion, the retention portion of said carrier portion cooperative with one or more of said retention elements to retain said at least one conductor carrier portion on said base portion;

an encasement assembly, comprising a housing engagable with one or more of said retention elements to retain said housing on said base portion, said housing having an orifice formed therein and further defining a cavity; and a pushbutton assembly disposed within said cavity along a vertical axis, comprising a pushbutton actuator extending through said orifice and aligned with said vertical axis, a bias element disposed between said pushbutton actuator and said base portion, and a slider block having at least one electrical shorting element disposed therein and in electrical contact with one set of said contacts, said slider block coupled to said pushbutton actuator for translation coaxial with said vertical axis.

2. The switch of claim 1 wherein said first set of contacts extends from a first surface of said at least one conductor carrier and said second set of contacts extends through said base portion when said at least one conductor carrier portion is retained against said base portion.

3. The switch of claim 1 wherein said housing has a first housing surface adjacent at least one second housing surface, said at least one second housing surface juxtaposed said base portion, said at least one second housing surface having a first edge.

4. The switch of claim 3 wherein said at least one second housing surface has at least one recess formed therein, said at least one recess having a retention gap formed at a locus proximate said first edge.

5. The switch of claim 4 wherein said at least one housing retention element cooperates with said retention gap to retain said housing on said base portion.

6. The switch of claim 1 wherein said bias element is a spring.

7. The switch of claim 1 wherein said bias element provides nonlinear resistance to a compressive force imparted on said bias element.

8. The switch of claim 1 wherein said pushbutton actuator comprises a shaft portion and a mounting portion.

9. The switch of claim 8 wherein said shaft portion has a distal end disposed through said orifice, said shaft portion distal end having an annular groove formed therein.

10. The switch of claim 8 wherein said slider block is disposed on said mounting portion.

11. The switch of claim 9 wherein said orifice in said first housing surface is defined by a raised collar.

12. The switch of claim 11 wherein a flexible boot has a first coupling disposed about said annular groove in said distal end of said shaft portion and a second coupling disposed about said raised collar.

13. The switch of claim 1 wherein said slider block is integrally formed on said pushbutton actuator.

* * * * *